US006702205B1

(12) United States Patent
Abercrombie et al.

(10) Patent No.: US 6,702,205 B1
(45) Date of Patent: Mar. 9, 2004

(54) APPARATUS FOR REDIRECTING FLOW OF WATER EXITING A FIRE HYDRANT SUPPORT

(76) Inventors: Rick Abercrombie, 520 Shelly Dr., Pleasant Hill, CA (US) 94523; Nick Jackalone, 101 Quail Hollow, Martinez, CA (US) 94553

( * ) Notice: Subject to any disclaimer, the term of this patent is extended or adjusted under 35 U.S.C. 154(b) by 0 days.

(21) Appl. No.: 10/228,131

(22) Filed: Aug. 26, 2002

(51) Int. Cl.[7] ..... B05B 1/26

(52) U.S. Cl. ..... 239/505; 239/507; 239/509; 239/513; 239/521

(58) Field of Search ..... 239/505, 507, 239/509, 513, 521, 392, 222, 275, 285, 288, 288.3, 499, 504, 510, 512, 518, 522, 523, 593

(56) References Cited

U.S. PATENT DOCUMENTS

| | | | |
|---|---|---|---|
| 1,158,302 | A | 10/1915 | Sargent |
| 1,751,345 | A | 3/1930 | Matsui |
| 2,539,976 | A | 1/1951 | Samson et al. |
| 2,900,139 | A | 8/1959 | Hensley, Jr. |
| 3,375,851 | A | 4/1968 | Henry et al. |
| 3,847,159 | A | 11/1974 | Hofer |
| 4,343,435 | A | 8/1982 | Anderton et al. |
| 4,475,691 | A | 10/1984 | Hintz |
| D319,290 | S | 8/1991 | Miller |
| 5,810,044 | A | 9/1998 | Saidi |
| 6,179,228 | B1 | 1/2001 | Ramaker et al. |

*Primary Examiner*—Michael Mar
*Assistant Examiner*—Darren Gorman
(74) *Attorney, Agent, or Firm*—Thomas R. Lampe

(57) ABSTRACT

Apparatus for redirecting flow of water exiting a fire hydrant support includes a flange connector for releasably connecting the flange connector to a flange of the fire hydrant support, a handle connected to the flange connector for positioning the flange connector, and a water diverter pivotally mounted on the flange connector engageable by water exiting the fire hydrant support. The apparatus can be rotated about the fire hydrant support and the angle of the water diverter can be readily adjusted.

11 Claims, 3 Drawing Sheets

APPARATUS FOR REDIRECTING FLOW OF WATER EXITING A FIRE HYDRANT SUPPORT

TECHNICAL FIELD

This invention relates to apparatus for redirecting the flow of water exiting the exit opening of a fire hydrant support having a fire hydrant support flange surrounding the exit opening.

BACKGROUND OF THE INVENTION

Fire hydrants typically are mounted on fire hydrant supports in the form of pipes or conduits projecting upwardly and having a circular-shaped flange at the upper end thereof to which the fire hydrant is secured by bolts which are designed to shear if the fire hydrant is impacted or otherwise has a significant force applied thereto. Typically, such force is a result of a vehicle crashing into the fire hydrant.

Immediately after a fire hydrant has been broken away from its support, water in great volume and under considerable pressure exits the fire hydrant support. This can cause considerable property damage, can present a traffic hazard and can result in personal injuries.

Each hydrant normally has its own valve but these are often difficult to approach and/or access under such conditions. Fire fighter's gear quickly becomes soaked, impairing his or her performance and increasing the chance of injury.

Another approach to stopping water flow has been to shut down an entire water grid with which the hydrant is associated. During shut down the entire area serviced by the grid is unprotected.

As will be seen below, the present invention provides a means for quickly and efficiently diverting water flow from a fire hydrant support so that the valve associated with the hydrant can be approached and turned off. A single individual can divert the water while another individual attends to the valve.

U.S. Pat. No. 5,810,044, issued Sep. 22, 1998, discloses a system for controlling fluid flow from an outlet aperture, particularly a stand pipe such as a fire hydrant. According to the system, a first cylindrical collar element is positioned by operators using handles around the stand pipe. According to the patent, water is directed into and through a flexible pipe located above the stand pipe and directed away from the stand pipe. A second cylindrical element forms an annular space with the first cylindrical collar element and fluid fills the space and allegedly stabilizes the elements relative to the stand pipe.

There is no showing in U.S. Pat. No. 5,810,044 of a positive means to connect the fluid control system to the stand pipe. A number of individual's must operate the system and are subject to possible injury. Furthermore, water issues from fire hydrant supports with great force and in great volumes. Water spouting from a fire hydrant support can rise a great many feet into the air. It would appear that the device shown in U.S. Pat. No. 5,810,044 could not safely handle such volumes of water and deal with the forces caused thereby. It is likely that the high pressure, fast water flow passing through the bent flexible pipe would result in a highly unstable situation.

The following patents relating to water diverters of various types are known: U.S. Pat. No. Des.319,290, issued Aug. 20, 1991, U.S. Pat. No. 1,158,302, issued Oct. 26, 1915, U.S. Pat. No. 3,847,159, issued Nov. 12, 1974, U.S. Pat. No. 2,539,976, issued Jan. 30, 1951, U.S. Pat. No. 2,900,139, issued Aug. 18, 1959, U.S. Pat. No. 3,375,851, issued Apr. 2, 1968, U.S. Pat. No. 6,179,228, issued Jan. 30, 2001, U.S. Pat. No. 4,343,435, issued Aug. 10, 1982, U.S. Pat. No. 1,751,345, issued Mar. 18, 1930, and U.S. Pat. No. 4,475,691, issued Oct. 9, 1984. The devices are not suitable for use in diverting water exiting a fire hydrant support.

DISCLOSURE OF INVENTION

The present invention relates to an apparatus which can efficiently and quickly be applied to divert water from a fire hydrant support. The apparatus is easy to use, only one person being required to position the apparatus in place and divert water flow. Water can quickly be diverted in any desired direction. The apparatus is safe to use, a positive means being employed to retain the apparatus in place on the fire hydrant support until water shutoff has occurred.

The apparatus of the invention is for redirecting flow of water exiting the exit opening of a fire hydrant support having a circular-shaped fire hydrant support flange surrounding the exit opening.

The apparatus includes a flange connector defining a flange connector opening and including connector structure for releasably connecting the flange connector to the fire hydrant support flange.

The apparatus also includes handle structure connected to the flange connector and projecting therefrom for manually positioning the flange connector on the fire hydrant support with the connector structure in engagement with the fire hydrant support flange to releasably connect the flange connector and the fire hydrant support flange, the flange connector opening being in fluid flow communication with the exit opening of the fire hydrant support.

The invention also includes a water diverter mounted on the flange connector engageable by water passing through the fire hydrant support exit opening and the flange connector opening to divert flow thereof.

Other features, advantages and objects of the present invention will become apparent with reference to the following description and accompanying drawings.

BEST MODE FOR CARRYING OUT THE INVENTION

Figure 1:
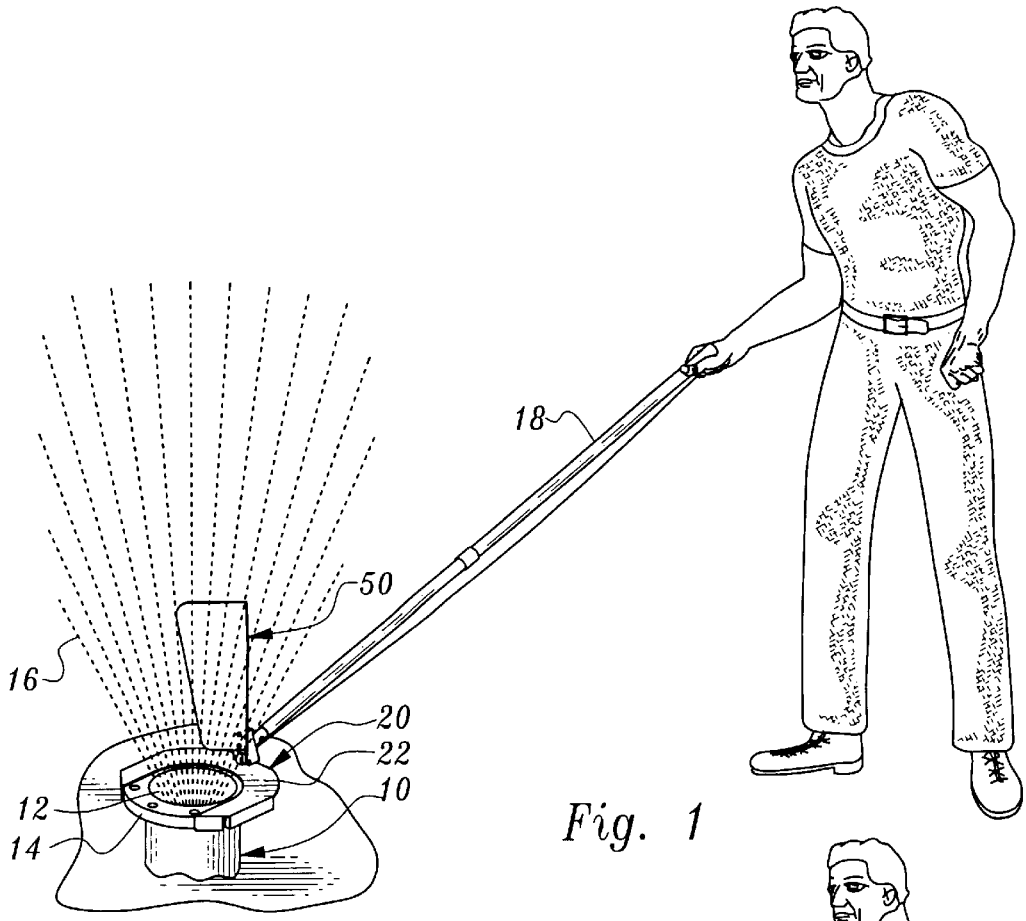
FIG. 1 shows apparatus constructed in accordance with the teachings of the present invention in position on a fire hydrant support, the water diverter being positioned by an individual so that no diverting of the water flow has as yet taken place.
Figure 2:
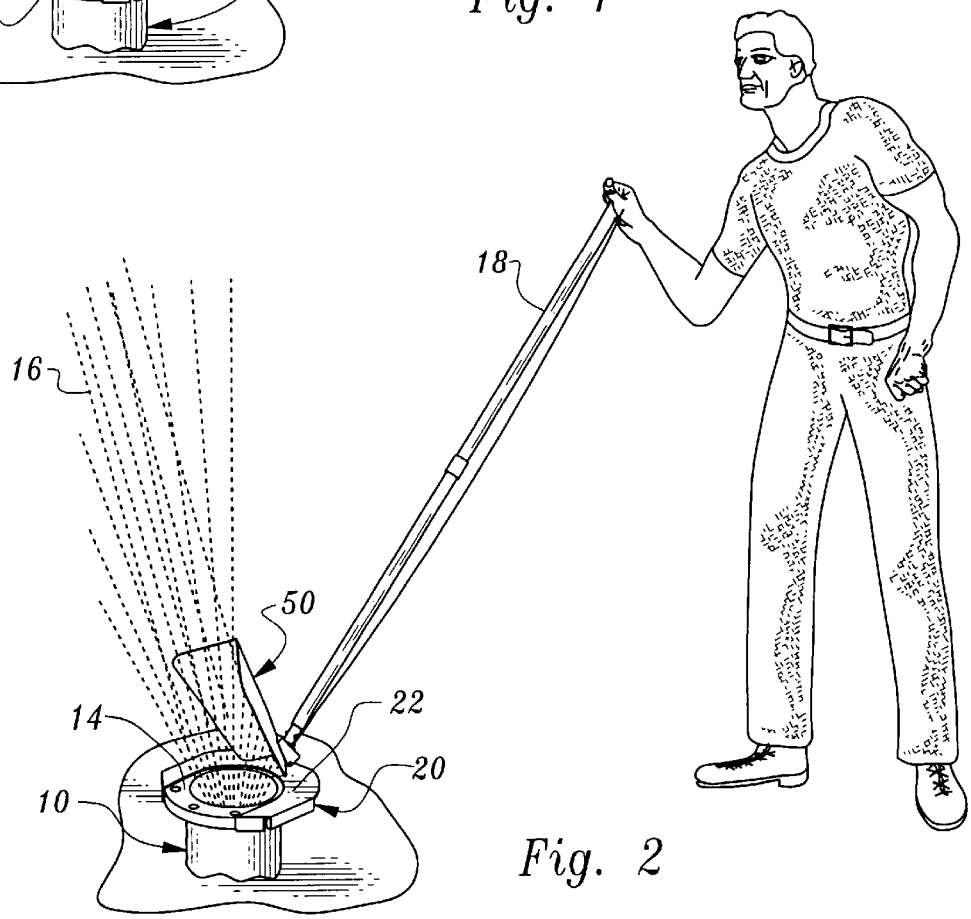
FIG. 2 is a view similar to FIG. 1, but illustrating the individual positioning the water diverter so that water flow is redirected.

Referring now to the drawings, a fire hydrant pipe or support 10 having an exit opening 12 and a circular-shaped flange 14 surrounding the exit opening is illustrated. FIGS. 1 and 2 illustrate water 16 exiting the exit opening 12, it being understood that the hydrant (not shown) normally associated with the support 10 has been inadvertently broken away, for example as a result of vehicular collision.

As has been indicated above, water often exits from fire hydrant support openings in great volume and under considerable pressure.

FIGS. 1 and 2 show an individual holding onto an elongated handle 18 of apparatus 20 constructed in accordance with the teachings of the present invention, the apparatus having been previously applied to the fire hydrant support in a manner which will be described in more detail below.

Apparatus 20 includes a flange connector 22 of generally U-shaped configuration. The flange connector 22 includes a connector top 24 positionable over the fire hydrant support flange and also connector sides 26, 28 projecting downwardly from the connector top. The connector sides are for positioning alongside the fire hydrant support flange to partially surround the support flange when the connector top is positioned over the flange.

Figure 4:
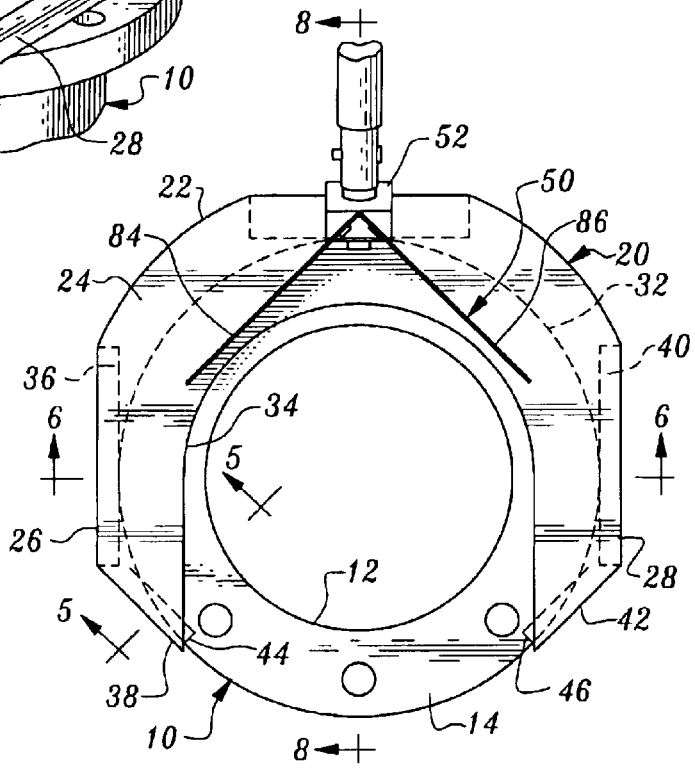
FIG. 4 is a top, plan view showing the apparatus in place on the flange, the water diverter not yet in a position to divert water flow.
Figure 6:
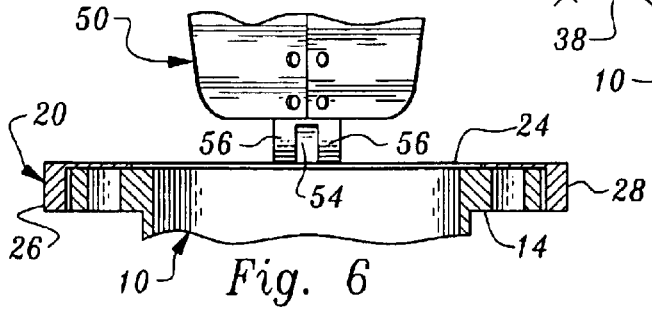
FIG. 6 is a cross-sectional view taken along the line 6—6 in FIG. 4.

Connector sides 26, 28 define a front space 30 and a rear space 32, the front space communicating with a flange connector opening 34 defined by the connector top 24. The front space accommodates the portion of the fire hydrant support flange projecting beyond the flange connector opening 34 (see FIG. 4) when the apparatus is in place.

Connector side 26 includes a first connector side segment 36 and a second connector side segment 38. Connector side 28 includes a first connector side segment 40 and a second connector side segment 42. The first connector side segments are diametrically opposed, spaced apart a distance greater than the diameter of the fire hydrant support flange and engageable with opposed sides of the fire hydrant support flange when the apparatus is in position to stabilize the apparatus.

The second connector side segments 38, 42 are closer together than the first connector side segments 36, 40 and are spaced apart a distance less than the diameter of the fire hydrant support flange.

Projections 44, 46 are attached to second connector side segments 38, 42 respectively and project under the fire hydrant support flange at locations on opposed sides of the front space 30 when the connector top is over the fire hydrant support flange and the apparatus is in place on the fire hydrant support.

The connector top, the second connector side segments 38, 42 and the projections 44, 46 define channels for receiving the fire hydrant support flange to substantially prevent up, down and rearward movement of the flange connector relative to the fire hydrant support flange, while allowing the flange connector to be turned by the handle structure 18 relative to the fire hydrant support flange. This allows water exiting through the exit opening 18 and communicating flange connector opening 34 to be redirected over a full 360 degree range, as selected by the operator.

Figure 3:
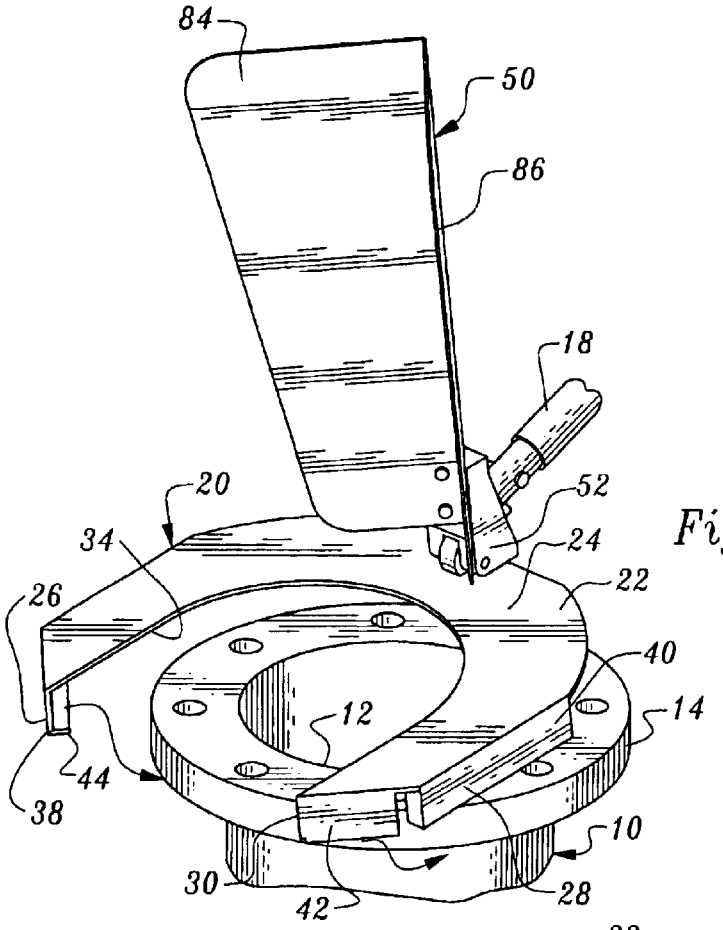
FIG. 3 is an enlarged, perspective view illustrating the flange connector and associated water diverter being positioned on the flange of a fire hydrant support.
Figure 5:
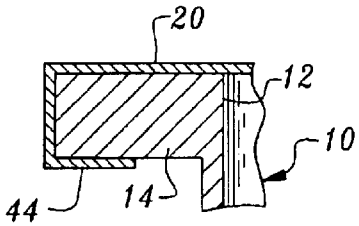
FIG. 5 is a greatly enlarged cross-sectional view taken along the line 5—5 in FIG. 4.

FIG. 3 shows the apparatus in the process of being connected to the flange 14. The operator simply places the flange connector 22 as shown in that figure by manipulating of handle 18 so that the second connector side elements 38, 42 bypass the front of the flange (as shown in FIG. 3) sufficiently for the second connector side segments and projections 44 affixed thereto to clear the flange. Next, the operator lowers the connector top 24 into engagement with the top of the flange. Finally, the operator pulls the handle toward himself or herself so that the flange is engaged by second connector side segments 38, 42 and the projections 44, 46 are situated thereunder. This is shown, for example, in FIG. 4. Water flows upwardly through the flange connector opening 34.

A water diverter 50 is disposed adjacent to opening 34 and is pivotally mounted on flange connector 22 by pivot structure 52. Pivot structure 52 includes a central pivot member 54 secured to connector top 24 and a pair of side pivot members 56 disposed on opposed sides of the central pivot member and pivotally connected thereto by a pivot pin 58. The side pivot members 56 are connected to both water diverter 50 and a handle connector element 60. Thus, pivotal movement of the water diverter 50 is readily effected by the operator moving the handle up and down. FIGS. 7–10 provide an illustration of this.

A lock pin or detent 70 is slidably mounted in the handle connector 60. A spring 72 biases the detent in the direction of central pivot member 54. A plurality of openings 74 are formed in member 54 and the detent is selectively alternatively positionable in these openings to selectively lock the water diverter 50 in a plurality of alternative orientations relative to the flange connector.

Figure 7:
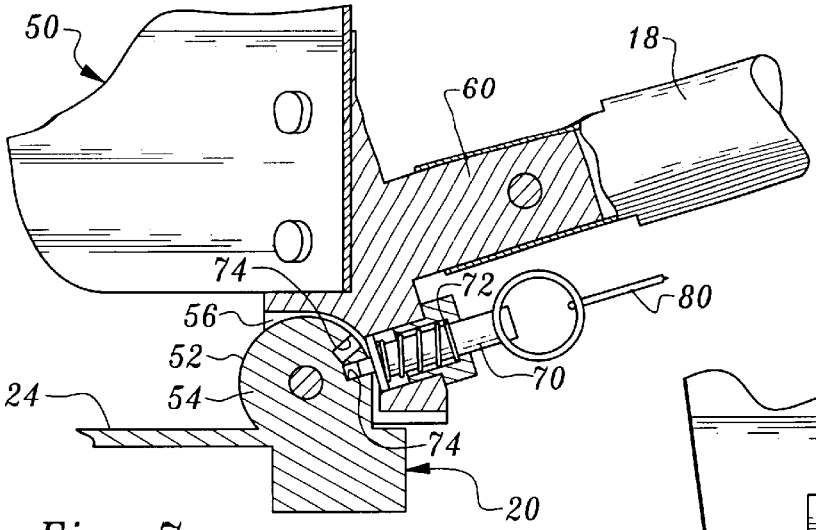
FIG. 7 is an enlarged, partially cross-sectional view showing operational details of pivot structure of the invention and an associated lock.
Figure 8:
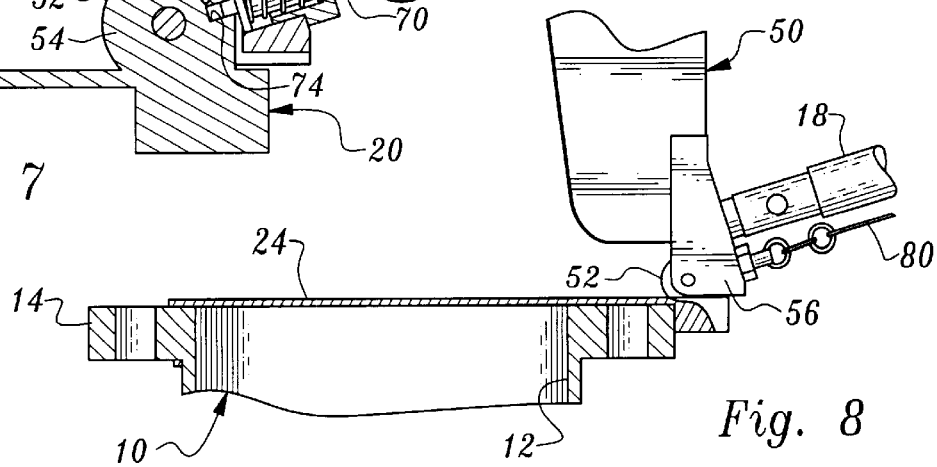
FIG. 8 is an enlarged cross-sectional view taken along the line 8—8 in FIG. 4.
Figure 9:
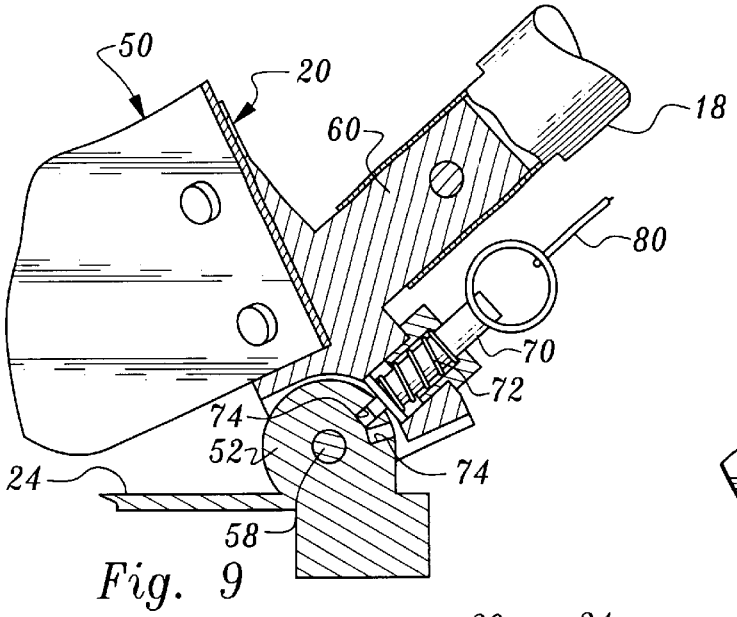
FIG. 9 is a view similar to FIG. 7, but illustrating the water diverter and handle structure of the invention locked at a different angle of inclination than that shown in FIG. 7.
Figure 10:
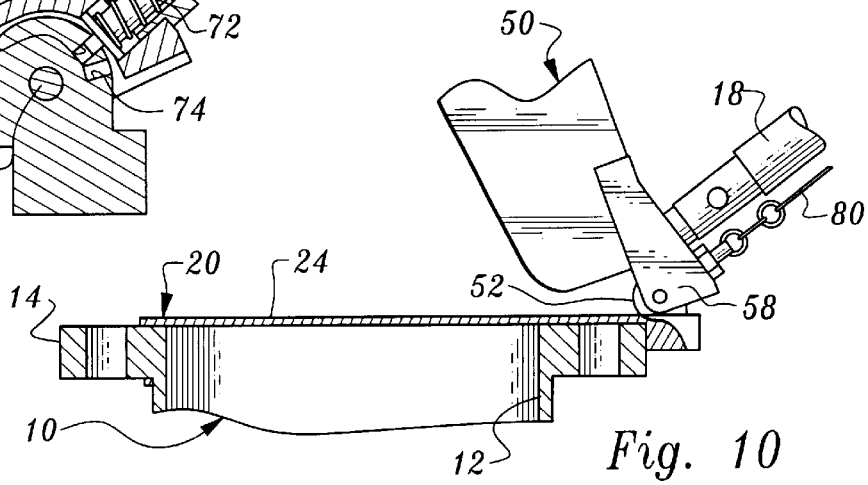
FIG. 10 is a view similar to FIG. 8, but illustrating the water diverter and handle structure at the angle of inclination shown in FIG. 9.

FIG. 7 shows the water diverter in one orientation wherein it is not positioned over the flowing water and FIG. 9 shows the water diverter in an alternate position wherein the water diverter is impacted by at least some of the flowing water to divert the water.

A release element in the form of a string or wire 80 can be pulled by the operator to disengage the detent from the central pivot member and allow the handle and water diverter to be pivoted. The flowing water impacting the water diverter exerts a force on the apparatus in the direction of handle 18 and operator, maintaining the flange in position in the channels formed by the second connector side segments and their associated projections.

The operator can safely divert water in many different directions. The amount of water diverted can be controlled by the inclination of the water diverter.

In the present arrangement, the water diverter 50 is in the form of two rigidly interconnected angularly disposed diverter members or plates 84, 86 defining a water flow channel and an open water exit end communicating with the water flow channel.

The invention claimed is:

1. Apparatus for redirecting flow of water exiting an exit opening of a fire hydrant support having a circular-shaped fire hydrant support flange surrounding the exit opening, said apparatus comprising, in combination:

a flange connector defining a flange connector opening and including connector structure for releasably connecting the flange connector to the fire hydrant support flange;

handle structure connected to the flange connector and projecting therefrom for manually positioning said flange connector on the fire hydrant support with said connector structure in engagement with the fire hydrant support flange to releasably connect the flange connector and the fire hydrant support flange, with the flange connector opening in fluid flow communication with the exit opening of the fire hydrant support; and a water diverter mounted on said flange connector engageable by water passing through said fire hydrant support exit opening and said flange connector opening to divert flow thereof.

2. The apparatus according to claim 1 additionally comprising pivot structure pivotally interconnecting said water diverter and said flange connector.

3. The apparatus according to claim 2 wherein said water diverter is attached to said handle structure, said handle structure being pivotally connected to said flange connector by said pivot structure and pivotal movement of said handle structure causing pivotal movement of said water diverter relative to said flange connector.

4. The apparatus according to claim 3 additionally comprising a lock for selectively locking said water diverter and handle structure against pivotal movement relative to said flange connector.

5. The apparatus according to claim 4 wherein said lock includes a detent element movably mounted relative to said handle and said water diverter selectively alternatively positionable in openings defined by the pivot structure to selectively lock said water diverter in a plurality of alternative orientations relative to said flange connector.

6. The apparatus according to claim 5 wherein said lock additionally includes a spring biasing said detent element toward said pivot structure and a manually actuatable release element for moving the distal element against the bias exerted thereon by said spring.

7. The apparatus according to claim 1 wherein said water diverter defines at least two rigidly interconnected angularly disposed diverter members defining a water flow channel and an open water exit end communicating with said water flow channel.

8. The apparatus according to claim 1 wherein said flange connector further includes a connector top positionable over said fire hydrant support flange and connector sides projecting downwardly from said connector top for positioning alongside said fire hydrant support flange to partially surround said fire hydrant support flange when said connector top is positioned over said fire hydrant support flange, said connector top defining said flange connector opening.

9. The apparatus according to claim 8 wherein said connector sides are spaced apart and define front and rear spaces, said front space communicating with said flange connector opening for accommodating a portion of the fire hydrant support flange projecting beyond the flange connector opening.

10. The apparatus according to claim 9 wherein each of said connector sides includes a first connector side segment and a second connector side segment, said first connector side segments being substantially diametrically opposed, spaced apart a distance greater than the diameter of the fire hydrant support flange and engageable with opposed sides of the fire hydrant support flange to stabilize said flange connector relative to the fire hydrant support flange.

11. The apparatus according to claim 10 wherein said second connector side segments are closer together than said first connector side segments, and spaced apart a distance less than the diameter of the fire hydrant support flange, said flange connector including projections attached to said second connector side segments for projecting under said fire hydrant support flange at locations on opposed sides of said front space when said connector top is disposed over said fire hydrant support flange, said connector top, said second connector side segments and said projections defining channels for receiving said fire hydrant support flange to substantially prevent up, down and rearward movement of said flange connector relative to the fire hydrant support flange while allowing the flange connector to be rotated by said handle structure relative to said fire hydrant support flange.

* * * * *